US007421809B2

(12) United States Patent
Pardella

(10) Patent No.: US 7,421,809 B2
(45) Date of Patent: Sep. 9, 2008

(54) SECURITY SENSITIVE LABEL AND METHOD FOR USE

(75) Inventor: Daniel E. Pardella, Petaluma, CA (US)

(73) Assignee: Sterling Graphics, Inc., Petaluma, CA (US)

( * ) Notice: Subject to any disclaimer, the term of this patent is extended or adjusted under 35 U.S.C. 154(b) by 0 days.

(21) Appl. No.: 11/278,203

(22) Filed: Mar. 31, 2006

(65) Prior Publication Data

US 2006/0196092 A1 Sep. 7, 2006

Related U.S. Application Data

(62) Division of application No. 10/668,782, filed on Sep. 23, 2003, now abandoned.

(51) Int. Cl.
*G09F 3/10* (2006.01)

(52) U.S. Cl. ..... 40/638; 283/81

(58) Field of Classification Search ..... 40/638; 283/81

See application file for complete search history.

(56) References Cited

U.S. PATENT DOCUMENTS

| | | | | |
|---|---|---|---|---|
| 2,845,728 A | | 8/1958 | Huber | |
| 3,221,427 A | | 12/1965 | Kaplan | |
| 4,239,261 A | | 12/1980 | Richardson | |
| 4,547,001 A | | 10/1985 | Stitt | |
| 4,763,928 A | | 8/1988 | Krietemeier et al. | |
| 4,787,158 A | * | 11/1988 | Vitol | 40/638 |
| 4,976,456 A | | 12/1990 | Jack | |
| 5,042,842 A | | 8/1991 | Green et al. | |
| 5,346,259 A | | 9/1994 | Mocilnikar et al. | |
| 5,429,391 A | * | 7/1995 | White, II | 283/70 |
| 5,486,022 A | | 1/1996 | Crane | |
| 5,732,979 A | | 3/1998 | Finke et al. | |
| 5,782,496 A | | 7/1998 | Casper et al. | |
| 5,884,425 A | | 3/1999 | Baldwin | |
| 6,428,867 B1 | | 8/2002 | Scott et al. | |
| 6,805,926 B2 | | 10/2004 | Cote et al. | |
| 2002/0021002 A1 | | 2/2002 | Finke et al. | |
| 2003/0047937 A1 | | 3/2003 | Chaduc et al. | |

FOREIGN PATENT DOCUMENTS

| | | | | |
|---|---|---|---|---|
| GB | 2278098 A | * | 11/1994 | 40/638 |

* cited by examiner

*Primary Examiner*—Gary C Hoge
(74) *Attorney, Agent, or Firm*—James F. Hann; Haynes Beffel & Wolfeld LLP

(57) ABSTRACT

A security sensitive label is applied to a product to help deter theft. The label includes a label body having inner and outer surfaces with a substrate-damaging adhesive on the inner surface. The outer surface has seller identification and theft-deterring indicia. Theft of a product may be deterred by application of the security sensitive label to the product so that if the product is stolen, (1) removal of the label may damage the substrate to which the label is applied, or (2) leaving the label on the product will alert a subsequent purchaser to the origin of the product, so that in either case the product becomes less saleable.

6 Claims, 1 Drawing Sheet

30

SECURITY SENSITIVE LABEL AND METHOD FOR USE

CROSS-REFERENCE TO OTHER APPLICATIONS

This Application is a division of U.S. patent application Ser. No. 10/668,782 filed on 23 Sep. 2003.

FEDERALLY SPONSORED RESEARCH OR DEVELOPMENT

None.

BACKGROUND OF THE INVENTION

Theft of consumer products is a common problem. Theft can occur during transportation, from warehouses and from retail stores, such as grocery stores. A wide variety of security devices have been devised to help prevent theft. One well-known system, often used in retail stores, involves applying a remotely sensible device to high value items in conjunction with a remote sensor at the exits. If the remotely sensible device is not either removed from the product or the actuated, an alarm sounds when the customer passes through the sensor at an exit. One problem with this type of system is that it is relatively expensive to implement and slows down checking out because of the time taken to deactuate or remove the device. Therefore, in some situations, such as the retail grocery store environment, such a system is not generally considered practical.

Another type of security label helps provide identification, such as through the use of micro markings or numbers, in the event the product is stolen. A further type of security label is temper evident and tears apart if the potential thief tries to remove the label and, for example, replace it with a different label having a lower price.

See U.S. Pat. Nos. 2,845,728; 3,221,427; 4,239,261; 4,547,001; 4,763,928; 4,976,456; 5,346,259; 5,782,496 and U.S. Published Application Nos. 2002/0021002 A1 and 2003/0047937 A1.

BRIEF SUMMARY OF THE INVENTION

There are at least two basic types of thieves. The personal thief steals for his or her own use. The commercial thief typically steals in larger quantities for resale to or at other retail outlets. Certain areas of a grocery store, such as the liquor section, stocking high-value items are the most prone to theft.

One aspect of the present invention is the recognition that because much of the theft from certain retail establishments, such as grocery stores, is the result of commercial thieves, one way to reduce such theft is to make the product less salable. Another aspect of the invention is the recognition that certain thieves, in particular the personal thief, may be deterred if there is an indication that the product may be remotely monitored in the event it leaves the store without having been paid for.

A further aspect of the invention is directed to a security sensitive label, for application to a product to help deter theft. The label includes a label body having inner and outer surfaces with a substrate-damaging adhesive on the inner surface. The outer surface comprises seller identification and theft-deterring indicia. Theft of a product may be deterred by application of the security sensitive label to the product so that if the product is stolen, (1) removal of the label may damage the substrate to which the label is applied, or (2) leaving the label on the product will alert a subsequent purchaser to the origin of the product, so that in either case the product becomes less saleable.

Is still further aspect of the invention is directed to a method for helping to deter theft of a product. A security sensitive label is selected. The label of comprises a label body having inner and outer surfaces with a substrate-damaging adhesive on the inner surface. The outer surface comprises seller identification and theft-deterring indicia. A label location on a product is chosen. The label location comprises an adhesive-damageable substrate with the label location being a normally visually observable location when the product is displayed for sale at retail. The label is applied to the label location on a product. Doing so helps to deter theft of the product because if the product is stolen, (1) removal of the label may damage the substrate to which the label is applied, or (2) leaving the label on the product will alert a subsequent purchaser to the origin of the product, so that in either case the product becomes less saleable.

Applying security sensitive label is to products will typically require additional labor. However, inventory studies have shown over a 50% reduction in lost inventory when a security sensitive label made according to the invention is used. Therefore, the additional labor costs required to apply the labels is offset by the time necessary to restock the shelves. When the security sensitive labels are used to reduce theft of high-value items, substantial monetary savings can also be realized.

Various features and advantages of the invention will appear from the following description in which the preferred embodiments have been set forth in detail in conjunction with the accompanying drawings.

DETAILED DESCRIPTION OF THE INVENTION

Figure 1:
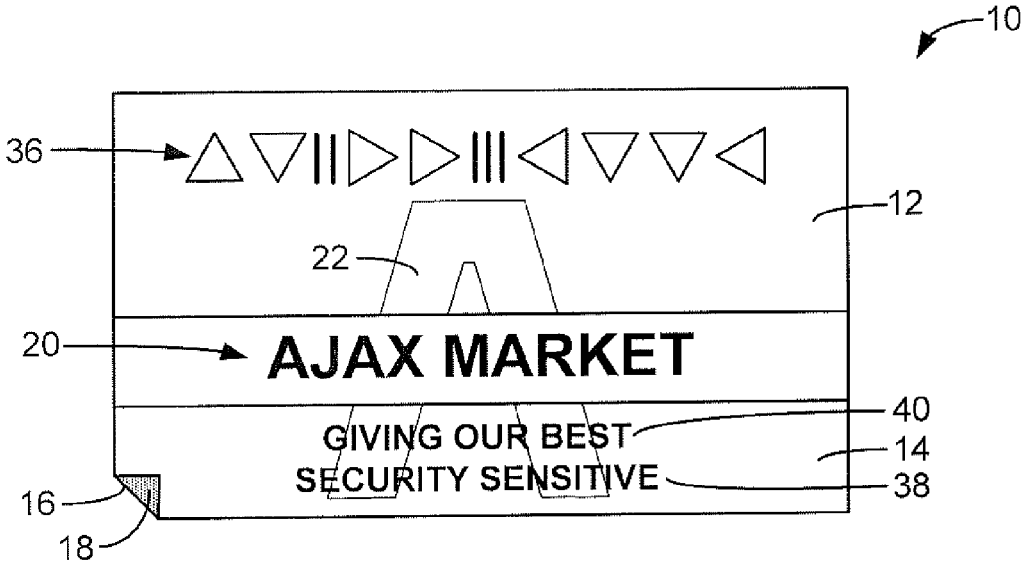
FIG. 1 is enlarged view of a security sensitive label made accoring to the invention.

FIG. 1 illustrates a security sensitive label 10, enlarged to show detail. A typical size for the label 10 is 1.375 in. by 0.75 inch; label 10 may be larger or smaller. Security sensitive label 10 is a one-piece label and includes a label body 12 having an outer surface 14 and an inner surface 16. Inner surface 16 has a substrate-damaging adhesive 18 applied thereto. Adhesive 18 is typically a high strength, contact adhesive chosen such that when label 10 is applied to a substrate, such as a paper label, the substrate is destroyed or damaged if security sensitive label 10 is removed from the substrate. The label body 12 is typically paper with a paper-substrate-damaging adhesive. Other materials for label body 12, such as paper or a composite, may also be used. A preferred self-adhesive paper label stock is sold as TP-500 by Technicote of Miamisburg, Ohio. Other substrate-damaging adhesives may be used when the substrate is other than paper, such as a polymer film or paint.

Figure 2:
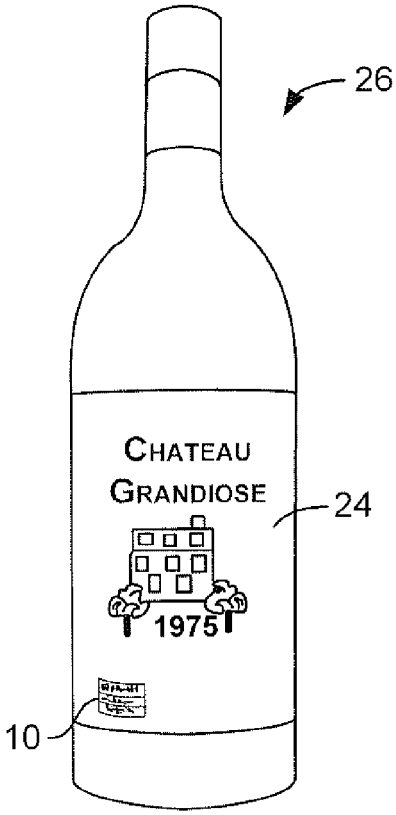
FIG. 2 illustrates the application of the cesurity sensitive label of FIG. 1 to the label of a bottle of wine.
Figure 3:
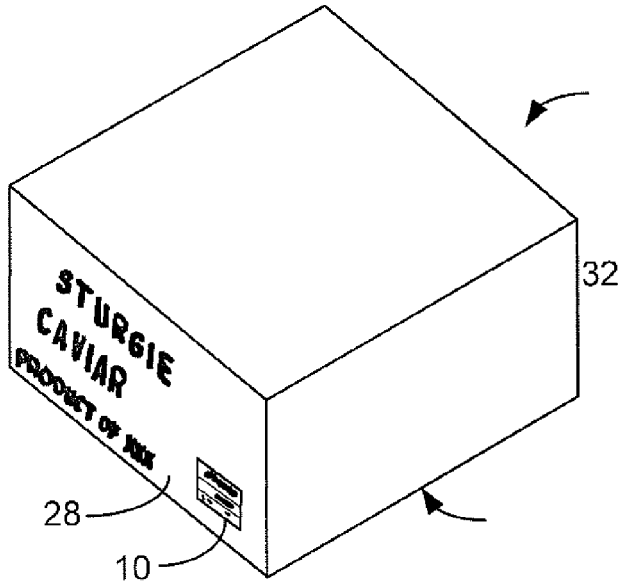
FIG. 3 shows the security sensitive label of FIG. 1 applied to the front of a packaged product.

The purpose of security sensitive label 10 is to help prevent theft of the product to which is applied. One aspect of the present invention is the recognition that because much of the theft from certain retail establishments, such as grocery stores, is the result of commercial thieves, one way to reduce such theft is to make the product less salable. Another aspect of the invention is the recognition that certain thieves, in particular the personal thief, may be deterred if there is an indication that the product may be remotely monitored in the event it leaves the store without having been paid for. To help accomplish these objectives, label 10 includes store identification, specifically the store, or other seller, name 20 and the store logo 22. Therefore, if a product has been stolen from store A, is very unlikely that store B would purchase or display such a product displaying security sensitive label 10 of store A. However, because label 10 is applied to a product substrate, such as front label 24 applied to a bottle of wine 26, shown in FIG. 2, or the front 28 of a package 30 of a packaged caviar product 32, shown in FIG. 3, store B would likely not purchase the stolen product from the thief unless security sensitive label 10 had previously been removed. Bottle of wine 26 and packaged caviar product 32 are both consumable products. However, the use of substrate-damaging adhesive 18 will cause, for example, front label 24 or front 28 of package 30 to be damaged if security sensitive label 10 is removed. In either event, that is the presence of a security sensitive label 10 for store A or the damage to the packaging caused by removal of the security sensitive label, may make the product not sellable or sellable only at a substantially reduced price. Either option makes the product much less desirable to steal by the commercial thief.

In addition to store name 20 and store logo 22, security sensitive label 10 has theft-deterring indicia in the form of security-type nonverbal markings 36 and security-type verbal statement 38. The use of the theft-deterring indicia is used to create an awareness in the potential thief whether the thief is a commercial thief or a personal thief that the product may be remotely monitored in the event it leaves the store (or other establishment) without having been paid for. Security-type nonverbal markings 36 are preferably potentially, and may be, machine-readable characters.

If desired, a promotional statement, such as statement 40, may be included on label 10 for marketing purposes. In the disclosed embodiment, the words "security sensitive" constitute security-type verbal statement 38; statement 38 may include a greater or lesser number of words and may include different words, such as "monitored", "monitored product", "special inventory", etc.

Other modification and variation can be made to the disclosed embodiments without departing from the subject of the invention as defined in following claims. For example, more than one security sensitive label 10 may be applied to a product.

Any and all patents, patent applications and printed publications referred to above are incorporated by reference.

The invention claimed is:

1. A method for helping to deter theft of a product comprising:

selecting theft-deterring indicia;

selecting a one-piece security sensitive label comprising:

a label body having inner and outer surfaces;

a substrate-damaging adhesive on the inner surface; and the outer surface comprising:

seller identification; and the theft-deterring indicia;

choosing a label location on a product, the label location comprising an adhesive-damageable substrate, the label location being a normally visually observable location when the product is displayed for sale at retail;

applying the one-piece label to the label location on a product;

displaying the product for sale at retail with the label visually observable by a prospective purchaser;

deterring theft of the product by virtue of the theft-deterring indicia; and deterring theft of the product because if the product is stolen:

removing the label may damage the substrate to which the label is applied so that the product becomes less saleable, and leaving the label on the product will alert a subsequent purchaser to the origin of the product by virtue of the seller identification so that the product becomes less saleable.

2. The method according to claim 1 wherein the choosing step is carried out with the adhesive-damageable substrate being a front label on a bottle of a consumable product.

3. The method according to claim 1 wherein the choosing step is carried out with the adhesive-damageable substrate being the front of packaging for a consumable product.

4. The method according to claim 1 wherein the first theft deterring step comprises creating an awareness that the product may be remotely monitored.

5. The method according to claim 1 wherein the choosing step is carried out with the adhesive-damageable substrate being the front of a consumable product.

6. A method for helping to deter theft of a consumable product from a store at retail comprising:

selecting theft-deterring indicia comprising security-type nonverbal markings and security-type verbal statement;

selecting a one-piece security sensitive label comprising:

a label body having inner and outer surfaces;

a paper-substrate-damaging adhesive on the inner surface; and the outer surface comprising:

store identification comprising a word and a logo; and the theft-deterring indicia:

choosing a label location on a consumable product, the label location comprising a paper substrate, the label location being a normally visually observable location when the product is displayed for sale at retail;

applying the one-piece label to the label location on the consumable product;

displaying the product for sale at retail with the label visually observable by a prospective purchaser;

deterring theft of the product by said label selecting, label location choosing, label applying and product displaying steps because of the theft-deterring indicia on the label applied to the normally visible label location on the product;

deterring theft of the product by virtue of the theft-deterring indicia creating an awareness that the product may be remotely monitored; and deterring theft of a product from a store by said label applying step because if the product is stolen from the store:

removing of the label will damage the paper substrate to which the label is applied so that the product becomes less saleable, and leaving the label on the product will alert a subsequent purchaser to the origin of the product so that the product becomes less saleable.

* * * * *